United States Patent [19]

Rausing

[11] Patent Number: 4,796,760

[45] Date of Patent: Jan. 10, 1989

[54] PACKING CONTAINER PROVIDED WITH OPENING ARRANGEMENT

[75] Inventor: Hans Rausing, Wadhurst, England

[73] Assignee: AB Tetra Pak, Lund, Sweden

[21] Appl. No.: 19,171

[22] Filed: Feb. 26, 1987

[30] Foreign Application Priority Data

Mar. 4, 1986 [GB] United Kingdom ..... 8605323

[51] Int. Cl.[4] ..... B65D 5/54

[52] U.S. Cl. ..... 206/606; 206/615; 206/628; 206/633

[58] Field of Search ..... 229/7 R, 17 R; 206/628, 206/606, 611, 615, 633

[56] References Cited

U.S. PATENT DOCUMENTS

| | | | |
|---|---|---|---|
| 1,827,636 | 10/1931 | Ames | 206/611 |
| 2,773,634 | 12/1956 | Negoro | 229/7 R |
| 3,134,531 | 5/1964 | Hardy, Jr. | 229/17 R |
| 3,261,538 | 7/1966 | Jones et al. | 206/633 |
| 3,964,670 | 6/1976 | Amneus | 206/633 |
| 3,977,591 | 8/1976 | Martensson et al. | 229/7 R |
| 4,294,362 | 10/1981 | Martensson | 206/622 |
| 4,301,927 | 11/1981 | Carlsson et al. | 206/622 |
| 4,343,402 | 8/1982 | Holmstrom | 206/622 |
| 4,410,128 | 10/1983 | Rausing | 229/17 R |
| 4,445,309 | 5/1984 | Reil | 53/410 |
| 4,566,928 | 1/1986 | Rausing | 156/217 |

FOREIGN PATENT DOCUMENTS

| | | | |
|---|---|---|---|
| 545601 | 9/1957 | Canada | 206/606 |
| 684394 | 4/1964 | Canada | 206/606 |
| 141229 | 5/1985 | European Pat. Off. | 229/17 R |
| 2377340 | 9/1978 | France | 206/606 |
| 507910 | 1/1955 | Italy | 206/606 |
| 568898 | 11/1975 | Switzerland | 229/17 R |

*Primary Examiner*—Stephen Marcus
*Assistant Examiner*—Gary E. Elkins
*Attorney, Agent, or Firm*—Burns, Doane, Swecker & Mathis

[57] ABSTRACT

A packing container (1) is provided with an opening arrangement comprising a pair of spaced lines of tearing perforations (8*a*, 8*b*) arranged in a wall portion of the container, the braking up of which causes the wall material between the perforations to be displaced so as to form a corresponding emptying opening when the container is opened. A hole (9) is provided extending through at least a portion of the thickness of the wall, e.g. through a central paper layer between two plastics layers, and connecting the spaced lines. An adjacent area of the wall bordering the hole is formed as a tongue (10), and a cover strip (11) being provided sealing over the hole.

8 Claims, 1 Drawing Sheet

PACKING CONTAINER PROVIDED WITH OPENING ARRANGEMENT

FIELD OF THE INVENTION

The present invention relates generally to packing containers and, more particularly, to a packing container provided with an opening arrangement of the type which comprises lines of tearing perforations arranged in the container wall, the breaking up of which causes the wall material between the perforations to be removed or cleared so as to form a corresponding emptying opening when the container is opened. The invention includes blanks for forming such containers and webs also relates to a linked succession of such blanks.

OBJECTS AND SUMMARY OF THE INVENTION

It is an object of the present invention to make available a packing container of the abovementioned type which, by contrast to such known containers, generally manufactured from cardboard or similar fibrous packing material, is easily openable and yet before opening is liquid-tight and is therefore very suitable for the packing of liquid or semi-liquid contents of the beverage type, e.g. milk, juice etc, as well as creams, puddings, butter etc.

It is a further object to provide a simple, inexpensive and readily manufactured packing container which in spite of material-weakening perforations can be made sufficiently difficult to open in order to avoid spontaneous opening under stress conditions in connection with normal handling, transport etc.

The present invention provides a packing container provided with an opening arrangement comprising a pair of spaced lines of tearing perforations arranged in a wall portion of the container, the breaking up of which causes the wall material between the perforations to be displaced so as to form a corresponding emptying opening when the container is opened, wherein a hole is provided extending through at least a portion of the thickness of the wall and connecting the spaced lines, an adjacent area of the wall bordering the hole being formed as a tongue, and a cover strip is provided sealing over said hole.

In a second aspect, the invention provides a blank for folding and sealing to form a container which blank has thereon a pair of spaced lines of tearing perforations arranged to form an opening arrangement in a container formed from the blank, wherein a hole is provided extending through at least a portion of the thickness of the blank and connecting said spaced lines, an adjacent area of the wall bordering the hole being formed as a tongue, and a cover strip is provided sealing over the hole.

Preferably, the packing container has the characteristic that at least one end of each tearing perforation is connected to a hole provided in the container wall which is designed so that the wall material between the perforations forms a tongue projecting into the hole to form a pull-lug, and that the hole is closed by a cover strip arranged over the hole which is sealed to the container wall in the area of the tongue.

The invention includes a web of packaging material comprising such blanks joined end to end.

BRIEF DESCRIPTION OF THE DRAWING

The invention will now be illustrated and explained in more detail with reference to the accompanying drawings wherein.

DETAILED DESCRIPTION OF A PREFERRED EMBODIMENT

Figure 1A:
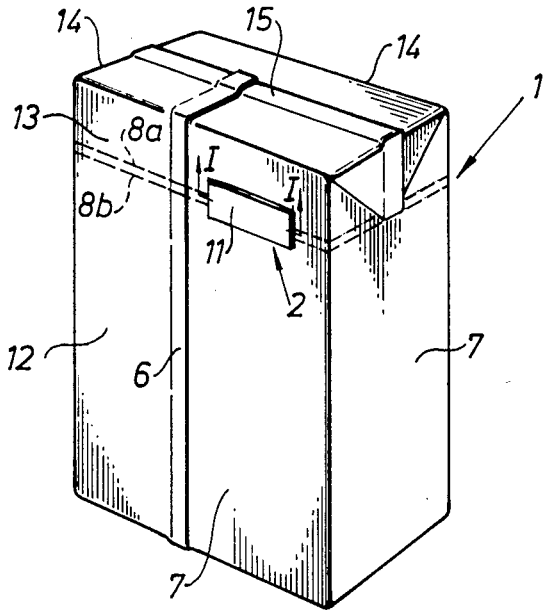
FIG. 1*a* is perspective view of a container known in itself which is provided with an opening arrangement in accordance with the invention.

In FIG. 1*a* it is thus shown in closed condition a packing container 1 known in itself which is provided with an opening arrangement 2 in accordance with the present invention. The packing container 1 is of the type available under the registered Trade Mark "TETRA BRIK" which can be manufactured from a packing laminate comprising at least one base layer 3 (FIG. 1*c*) consisting of paper which is covered on both sides with liquid-tight layers 4 and 5 respectively of thermoplastics, e.g. polythene.

To improve the gas-tightness it may be necessary occasionally for a packing laminate also to include a layer of a gas-tight material e.g. Al-foil. In the example shown here is it assumed, however, that the packing laminate only comprises the base layer 3 of paper coated on both sides with plastics.

The packing laminate is fed in the form of a web to a packing machine and is folded over and sealed along a so-called overlap joint 6 in order to form a liquid-tight tube which is filled with the desired contents. The tube is then processed with the help of sealing jaws which at uniform intervals flatten the material tube so that its walls rest against each other in narrow transverse zones. With the help of the sealing jaws the material is heated in the zones as a result of which a fusing together of the thermoplastic layers on the inside of the material tube pressed together will be achieved with a division of the material tube into individual liquid-tight packing containers. The packing containers are then separated from one another by means of transverese cuts in the sealing zones, whereafter they are subjected to a form processing which converts the packing containers to the parallelepipedic shape shown.

Figure 1B:
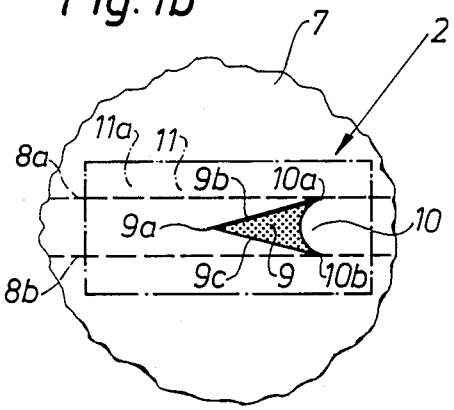
FIG. 1*b* is an enlargement of the area encircled in FIG. 1*a* with the cover strip taken off.
Figure 1C:
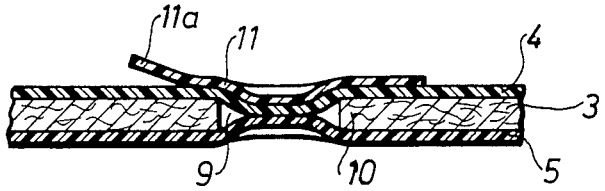
FIG. 1*c* is a sectional view along the line I—I in FIG. 1*a*.

As can best be seen from FIG. 1*b*, the opening arrangement 2 on the container 1 is provided with a weakening indication arranged in the container wall 7 consisting e.g. of two parallel tearing perforations extending horizontally around the container whose ends are connected to each other by a hole 9 provided in the container wall 7. The tearing perforations 8*a* and 8*b*, which may be e.g. through-holes or slots, as well as the hole 9, preferably can be arranged as shown in FIG. 1*c*, in the central paper layer 3 before the same is coated with the plastic layers 4 and 5. The advantage gained by this is that the packing material is liquid-tight, since the perforations and the hole are covered by plastic material.

The hole 9 is so designed in accordance with the invention that the wall material between the perforations 8*a* and 8*b* forms a tongue 10 projecting into the hole 9 whose purpose is to facilitate the initial breaking up of the perforations when the container 1 is to be opened. Over the hole 9 is provided, moreover, a strip 11, which has a free end 11*a* serving as a pull-lug, the strip 11 being sealed to the container wall 7 in the area of the tongue 10. As is evident from FIG. 1*c*, the strip 11 is also sealed to the top plastic layer 4 in the area of the hole 9. In addition, in the example shown, this upper plastics layer 4 will be sealed also to the bottom plastic layer 5 within this area. Hence the hole 9 will be covered by three material layers which are joined to one another by means of the said seals. To make possible an uncovering of the hole 9 when the container 1 is to be opened with the help of the strip 11, as will be described below, it is important that the seal between the strip 11 and the top plastic layer 4 over the hole 9 and in the area of the tongue 10 should be sufficiently strong to prevent a delamination of the strip 11 from this layer. In this case the strip 11 consists wholly of, or has its underside (the side facing the plastics layer 4) coated with, a thermoplastic layer e.g. polythene, such a safe seal between the strip 11 and the plastic layer 4 can be achieved in a simple manner by so-called heat-sealing.

An opening arrangement which is very easily operable is provided in accordance with the invention if the hole 9 is given the arrow-shaped design shown in FIG. 1*b*, with the part of the hole remote from the tongue 10 terminating in a point 9*a*. From the points of connection 10*a* and 10*b* of the tongue 10 to the perforations 8*a* and 8*b* respectively extend two straight edge lines 9*b* and 9*c* which converge towards and terminate in the said point 9*a*, the tongue 10 and the two edge lines 9*b* and 9*c* together forming the contours of the hole 9.

The packing container 1 in FIG. 1*a* is opened in that with the help of the free pull-lug 11*a* on the strip 11 the strip is pulled backwards, to the right in the FIGS. 1*b* and 1*c*, and as this happens, the plastics layers 4 and 5, owing to their being sealed to each other and to the underside of the strip 11, are torn asunder along the edge lines 9*b* and 9*c* of the hole 9, as a result of which the arrow-shaped hole is laid open. On continued pulling of the strip 11 the tongue 10 sealed to the underside of the strip will be lifted upwards and backwards, causing an initial breaking up of the perforations 8*a* and 8*b* to occur. A complete breaking up of these perforations brings about a total tearing off of the wall material located around the whole container between the perforations 8*a* and 8*b*, dividing the container 1 into two parts separated from each other (that is to say a bottom part 12 and a lift-off lid part 13).

The location of the opening arrangement 2 on the container 1 is not critical for the invention but may be varied and adapted to the contents of the container 1. The location shown in FIG. 1*a* with the perforations 8*a* and 8*b* extending around the container directly below the upper boundary lines 14 of the walls 7 is particularly suitable for contents of the type of creams, puddings, yoghurts etc. which are intended to be eaten directly from the container with the help, for example, of a spoon. If instead the perforations are arranged to extend parallel with, and close to, the longitudinal sealing joint 6 shown, a packing container is obtained which is very suitable for contents of the type of butter, margarine etc. Furthermore, it is conceivable for the perforations to be arranged directly below and wholly around the upper sealing fin 15 formed as a result of the transverse sealing. Such a container could be used, for example, for the packaging of juice intended to be kept in frozen state (so-called fruit bar).

The illustrated container may be assembled from a sheet-form blank in which the lines of perforations extend across the whole width or substantially the whole width of the blank and are mutually parallel.

Such blanks are preferably made in the form of a continuous web containing a series of blanks integrally joined end to end.

While this invention has been illustrated and described in accordance with a preferred embodiment, it is recognized that variations and changes may be made and equivalents employed herein without departing from the invention as set forth in the claims.

What is claimed is:

1. In a packing container, an opening arrangement comprising:

a wall portion having an interior surface and a pair of spaced tearing perforations arranged to define a strip of wall material therebetween;

a hole interconnecting said pair of spaced tearing perforations, said strip adjacent said hole being formed as a tongue, said hole being bordered by two edges extending from points of connection of the tongue to the lines of tearing perforations and converging towards a single point, the tongue and the two edges together forming the borders of the hole;

a cover strips sealed to said wall portion and extending across said wall strip and over said hole; and a first thin liquid tight plastics film sealed to said interior surface of said wall portion and covering said hole, a portion of the cover strip exposed to the hole being sealed to the immediately underlying plastics film.

2. The arrangement as claimed in claim 1 wherein said wall portion is a laminate comprising a first layer containing said hole and said first thin liquid-tight plastics film.

3. The arrangement as claimed in claim 2 wherein said laminate comprises a second thin liquid-tight plastics film sealed to the opposite side of said first layer as said first film, the first and second films being sealed to each other at said hole.

4. The arrangement as claimed in claim 1, wherein the cover strip has a free pull-lug unattached to the container wall.

5. The arrangement as claimed in claim 1, wherein the spaced tearing perforations extend around the container starting and ending at the hole.

6. An opening arrangement comprising:

a packing container having a container wall formed of a wall material, said container wall having an inner surface, a pair of tearing perforations in said container wall arranged to form an opening in said container wall when wall material between said tearing perforations is removed, said container wall having a hole extending between said tearing perforations, said hole having a first edge in the shape of a tongue projecting into said hole, and second and third edges extending from points of connection of the tongue to the tearing perforations and converging towards a single point, the first, second and third edges together forming the borders of the hole;

a cover strip arranged over said hole and sealed to said container wall at said tongue; and a thin liquid-tight plastic film covering the hole from underneath and being sealed to the inner surface of the container wall, the cover strip being sealed to the plastic film at the hole.

7. The arrangement in accordance with claim 6 wherein the cover strip has a free pull-lug.

8. The arrangement in accordance with claim 6 wherein the pair of tearing perforations extend around the container and are connected to the first, second and third edges of the hole at opposite ends of the tearing perforations.

* * * * *